United States Patent [19]

Kodera et al.

[11] Patent Number: 4,636,701

[45] Date of Patent: Jan. 13, 1987

[54] SYSTEM FOR CONTROLLING ROTATION OF ROTARY MECHANISM IN Z-TYPE PROPULSION APPARATUS

[75] Inventors: Masanori Kodera, Chigasaki; Yasuo Aizawa, Hiratsuka; Kohji Ichijo, Tokyo, all of Japan

[73] Assignee: Niigata Engineering Co., Ltd., Tokyo, Japan

[21] Appl. No.: 599,517

[22] Filed: Apr. 12, 1984

[30] Foreign Application Priority Data

Apr. 12, 1983 [JP] Japan ..... 58-54440[U]
May 9, 1983 [JP] Japan ..... 58-68852[U]

[51] Int. Cl.[4] ..... G05B 1/06
[52] U.S. Cl. ..... 318/635; 318/588; 318/604; 318/663
[58] Field of Search ..... 318/663, 588, 604, 565, 318/685, 635

[56] References Cited

U.S. PATENT DOCUMENTS

| | | | |
|---|---|---|---|
| 3,525,918 | 8/1970 | Parnell | 318/626 |
| 3,778,696 | 12/1973 | Walters et al. | 318/565 |
| 3,798,525 | 3/1974 | Cooper | 318/588 |
| 3,942,087 | 3/1976 | Maisch et al. | 318/635 X |
| 3,950,687 | 4/1976 | Watson | 318/635 X |
| 4,191,913 | 3/1980 | Arnold et al. | 318/565 |
| 4,251,760 | 2/1981 | Gersch | 318/604 |
| 4,413,215 | 11/1983 | Cavil | 318/588 |

*Primary Examiner*—Benjamin Dobeck
*Attorney, Agent, or Firm*—Scully, Scott, Murphy & Presser

[57] ABSTRACT

A control system for controlling the rotation of a rotary mechanism such as a propeller housing in a Z-type propulsion apparatus is provided. A command signal and a feedback signal both relating to the rotation of the rotary mechanism are compared with each other. And a control signal which varies at a predetermined inclination is generated when the command and feedback signals differ in amplitude from each other. And a drive unit rotates the rotary mechanism in accordance with the control signal.

7 Claims, 13 Drawing Figures

SYSTEM FOR CONTROLLING ROTATION OF ROTARY MECHANISM IN Z-TYPE PROPULSION APPARATUS

BACKGROUND OF THE INVENTION

1. Field of the Invention

This invention relates to a system for controlling the rotation of a rotary mechanism such as a propeller housing in a Z-type propulsion apparatus for a watercraft.

2. Prior Art

In recent years, harbors have become much crowded with vessels of a large size. Therefore, it has been required that tug boats should operate to move the vessel toward and away from the shore in a safe and rapid manner. For this reason, there have now been extensively used tug boats equipped with a Z-type propulsion apparatus which can easily vary the direction of propulsion over the range of 360 degrees. FIG. 1 shows one conventional system for controlling the rotation of a propeller housing of such a Z-type propulsion apparatus mounted on a tug boat. There is provided in the control system a pivotal steering arm 1 for commanding the propeller housing to rotate by a desired amount of angle in a selected direction. The steering arm 1 is provided with an angular position detector 2 for detecting the angular position of the steering arm 1. There is also provided another angular position detector 3 for detecting the angular position of the propeller housing. Both outputs of the detectors 2 and 3 are supplied to a servo-control circuit 4 which in turn generates a servo-control signal to a servo-motor 5. An output shaft of the servo-motor 5 is connected to an input shaft of a hydraulic pump 6, and input and output ports of the pump 6 are connected to a pair of ports of a hydraulic cylinder 7 via the respective connecting tubes. The piston of the cylinder 7 is connected to an input shaft of another hydraulic motor 8 through a piston rod 7*a* and an arm 8*a* so that the input shaft of the hydraulic motor 8 rotates in accordance with the movement of the piston. The hydraulic pump 8 is activated by an electric motor 9 and supplies the pressurized oil to a hydraulic motor 10, the amount and direction of flow of the oil varying in accordance with the angular position of the input shaft of pump 8. A worm 11 mounted on an output shaft of the hydraulic motor 10 is engaged with a worm wheel 12 which is coaxially mounted on the propeller housing.

With this construction, the propeller housing rotates in synchronism with the angular movement of the steering arm 1 and starts to rotate and stops smoothly by virtue of the provision of the servo-motor 5, hydraulic motor 6 and hydraulic cylinder 7. This conventional control system is however rather complicated in construction and it is therefore difficult to reduce its size as well as its manufacturing costs.

FIG. 2 shows another conventional control system specifically designed to overcome the above-mentioned disadvantages. In this control system, an electronic servo-control circuit 13 having a delay function is provided to directly control a servo-valve 16. The servo-valve 16 controls the amount and direction of flow of oil from a hydraulic pump 15, which is driven by an electric motor 14, and supplies the controlled oil to a hydraulic motor 17. This hydraulic motor 17 is to drive the worm 11.

This control system is however liable to be adversely affected by the variation of ambient temperature and noises since the servo-control circuit 13 comprises electronic amplifiers. Another deficiency of this control system is that the propeller housing begins to rotate with much delay when the signal level of the output signal S of the servo-control circuit 13 is small. As is seen from FIG. 3, the output signal S at a small signal level S2 rises at a less inclination than that at a large signal level S1. The propeller housing is driven by the output signal S through a control mechanism having a dead zone B. The propeller housing therefore begins to rotate in response to the small level signal S2 with a delay period t2 which is greater than a delay period t1 corresponding to the large level signal S1. Further, the propeller housing is subjected to vibration during a deceleration of the rotation of the same if the time constant of the servo-control system is set to a small value in order to avoid hunting of the propeller housing. The vibration can be avoided by setting the time constant to a large value, in this case however the propeller housing may be subjected to the hunting.

SUMMARY OF THE INVENTION

It is therefore an object of the invention to provide a system for controlling the rotation of a rotary mechanism in a Z-type propulsion apparatus in which the rotary mechanism starts to rotate and stops smoothly.

It is another object of the invention to provide such a control system in which the rotary mechanism may not be subjected to vibration and hunting.

It is a further object of the invention to provide such a control system which can be reduced in size and can be manufactured at less costs.

It is a still further object of the invention to provide such a control system in which the rotary mechanism starts to rotate with a constant delay irrespective of the signal level of a servo-control signal.

It is a still further object of the invention to provide such a control system by which the rotary mechanism can be rotated accurately even when the signal level of the servo-control signal is small.

According to the present invention, there is provided a system for controlling the rotation of a rotary mechanism in a Z-type propulsion apparatus which system comprises a command signal generating device; a feedback signal detecting device for detecting a feedback signal relating to the rotation of the rotary mechanism; a control signal generating circuit for generating a control signal whose signal level is varied at a predetermined inclination when the signal levels of the command and feedback signals differ from each other; and a drive unit for rotating the rotary mechanism in accordance with the signal level of the control signal.

DESCRIPTION OF THE PREFERRED EMBODIMENTS OF THE INVENTION

Figure 1:
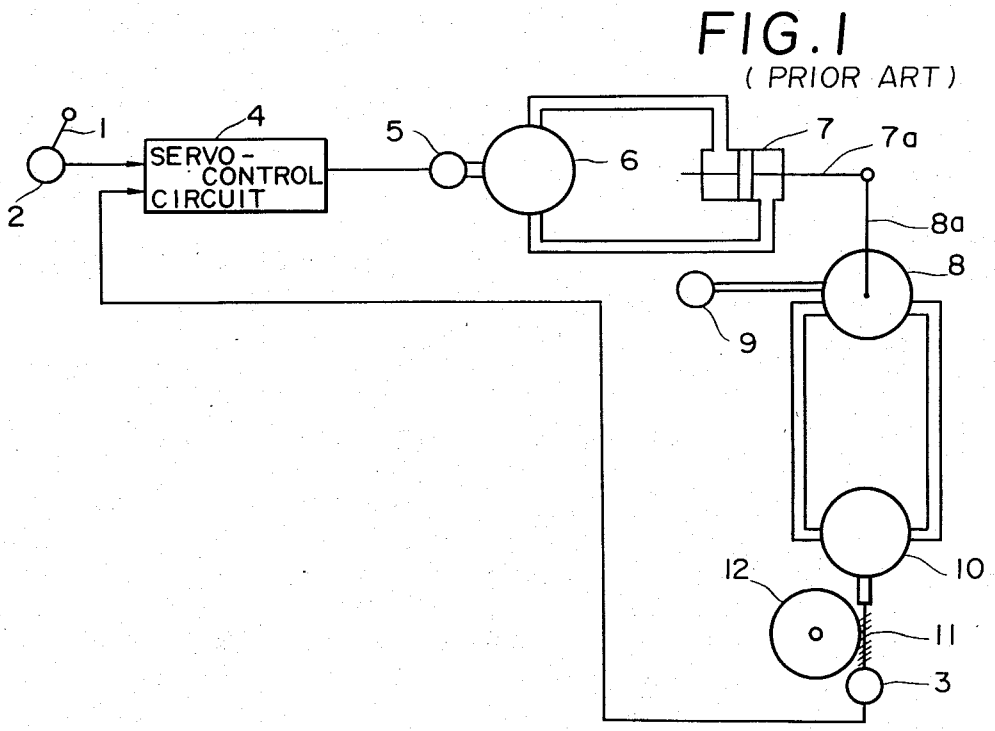
FIG. 1 (PRIOR ART)
FIG. 1 is a block diagram of a conventional system for controlling the rotation of a propeller housing.
Figure 3:
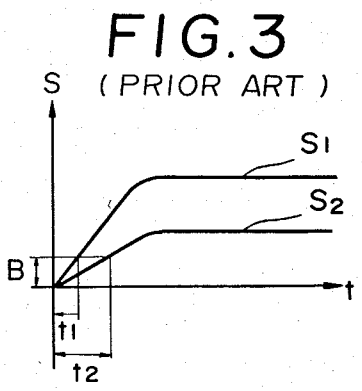
FIG. 3 (PRIOR ART)
FIG. 3 is a diagrammatic illustration showing the wave forms of the servo-control signal of the control system shown in FIG. 2.
Figure 2:
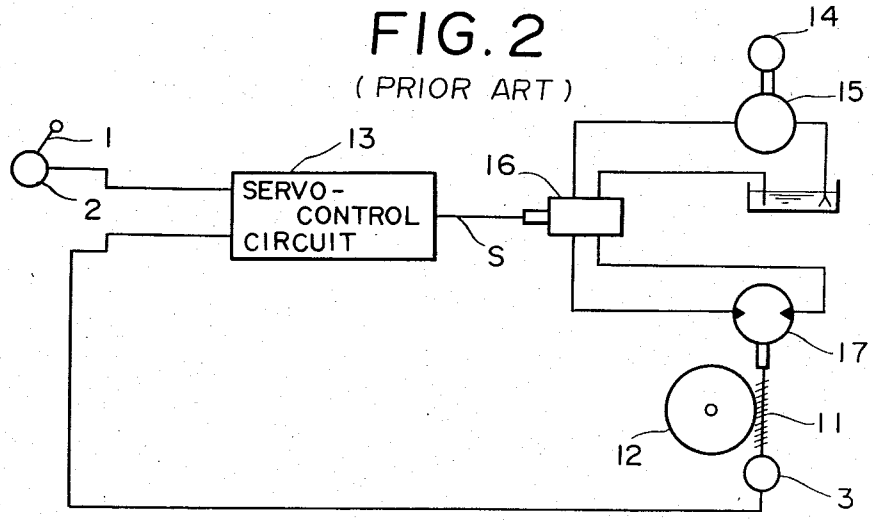
FIG. 2 (PRIOR ART)
FIG. 2 is a block diagram of another conventional control system.
Figure 5:
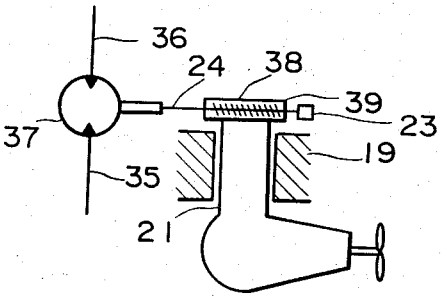
FIG. 5 is a schematic view of the propeller housing of the system of FIG. 4 showing the hydraulic motor connected thereto.
Figure 4:
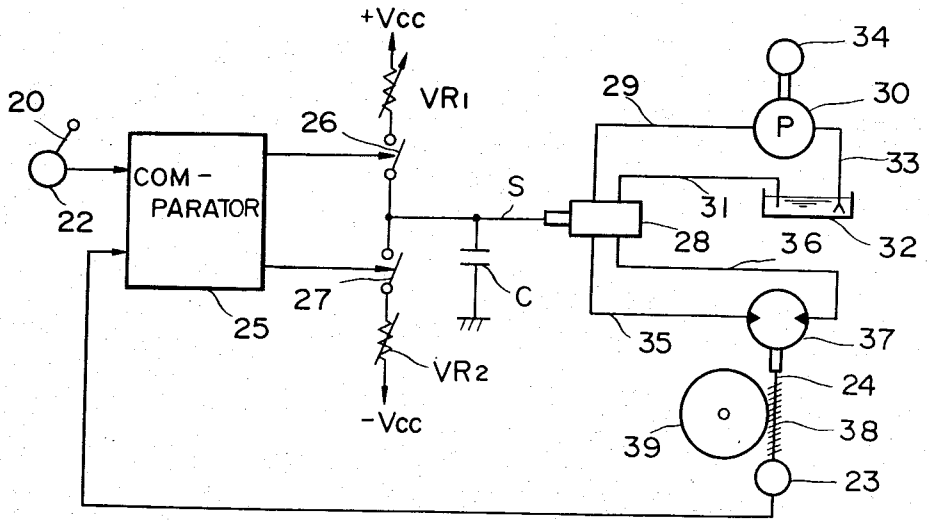
FIG. 4 is a block diagram of a system for controlling the rotation of a propeller housing, provided in accordance with the present invention.

FIGS. 4 and 5 show a system for controlling the rotation of a propeller housing of a tug boat, provided in accordance with the present invention. There is shown in the figures a steering arm 20 for commanding a propeller housing 21 to rotate, the propeller housing 21 being rotatably mounted on a hull 19 of the tug boat. The steering arm 20 is pivotally mounted on a steering control panel (not shown) of the tug boat and is provided with an angular position detector 22 such as a potentiometer and a synchro for detecting the angular position of the steering arm 20. The output signal of the detector 22 represents the angle at which the propeller housing 21 is to be oriented and is referred to hereinafter as a command signal. There is provided another detector 23 such as a potentiometer and a synchro for detecting the angular position of the propeller housing 21. The angular position detector 23 is connected to a shaft 24 through a series of gears so as to output a signal representative of the angular position of the propeller housing 21 which signal is referred to hereinafter as a feedback signal. The command and feedback signals outputted from the detectors 22 and 23 are fed to input terminals of a comparator 25. The comparator 25 compares the two signals with each other and energizes one of switches 26 and 27 in accordance with the comparison result. More specifically, the comparator 25 closes the switch 26 when the command signal is greater than the feedback signal while it closes the switch 27 when the command signal is smaller than the feedback signal. When the both signals are equal to each other in amplitude the switches 26 and 27 are maintained in the open states. One of the contacts of the switch 26 is connected to a positive power source +Vcc through a variable resistor VR1 and the other contact of the switch 26 is connected to one terminal of a capacitor C1. Similarly, one of the contacts of the switch 27 is connected to a negative power source −Vcc through a variable resistor VR2 while the other contact of the switch 27 is connected to the one terminal of the capacitor C1 and to an input terminal of an electromagnetically controlled valve 28. The other terminal of the capacitor C1 is grounded. The control valve 28 is of such a type that the amount and direction of flow of oil are controlled in accordance with the amplitude and polarity of the signal supplied to the input terminal thereof, and the type of control valve is well known. An inlet of the control valve 28 is connected through a connecting tube 29 to an outlet of a hydraulic pump 30 while an outlet of the control valve 28 is connected through another connecting tube 31 to an oil reservoir 32. This oil reservoir 32 is also connected through a connecting tube 33 to an inlet of the hydraulic pump 30 which is driven by an electric motor 34. A pair of ports of the control valve 28 are connected through connecting tubes 35 and 36 to a pair of ports of a hydraulic motor 37. An output shaft of this hydraulic pump 37 is connected to the shaft 24 to which a worm 38 is secured. The worm 38 engages with a worm wheel 39 which is coaxially mounted on the top of the cylindrical portion of the propeller housing 21.

The operation of this control system will now be described. In the initial condition it is assumed that the angular position of the steering arm 20 coincides with that of the propeller housing 21. When the steering arm 20 is pivoted by a desired amount of angle in a selected direction a voltage difference between the command and feedback signals is fed to the comparator 25. In this case, if the command signal is greater than the feedback signal the comparator 25 closes the switch 26, so that the capacitor C1 is charged by the positive voltage source +Vcc through the variable resister VR1. In contrast, if the command signal is less than the feedback signal the comparator 25 closes the switch 27, so that the capacitor C1 is charged by the negative voltage source −Vcc through the variable resistor VR2. The voltage appearing at the one terminal of the capacitor C1 as a result of the charge is supplied to the input terminal of the control valve 28 to thereby control the amount and direction of flow of the oil. As a result, the hydraulic motor 37 is activated, so that the propeller housing 21 begins to rotate. Thereafter, when the angular position of the propeller housing 21 coincides with that of the steering arm 20 the command signal and the feedback signal become equal in amplitude to each other, so that the both switches 26 and 27 are rendered open. Consequently, the hydraulic motor 37 is deactivated and the propeller housing 21 stops.

Figure 7:
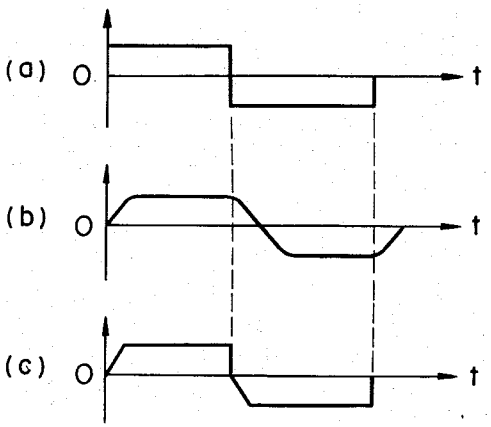
FIG. 7 is a diagrammatic illustration showing the response characteristics of the control system of FIG. 4 and of the conventional control system.
Figure 6:
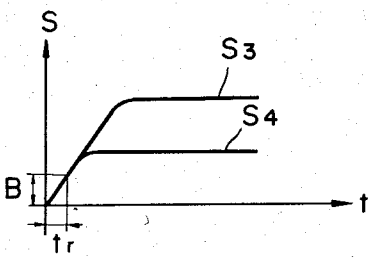
FIG. 6 is a diagrammatic illustration showing the wave forms of the input signal of the control valve 28 of FIG. 4.

It is appreciated from the above description that this control system has less mechanical component parts in comparison with the conventional control system. This control system is therefore simple and compact in construction and can be manufactured at lower costs. In addition, the electronic circuit involved in this control system only employs passive elements such as the variable resistors VR1 and VR2 and the capacitor C1, which are selectively used in accordance with the states of the switches 26 and 27, and employs no electronic amplifier. This control system is therefore less sensitive to the variation of ambient temperature and noises. This control system is also advantageous in that the positive and negative transition duration of the response in the control system can be individually adjusted. The input signal S of the control valve 28 is generated by charging the capacitor C1 with the positive voltage source +Vcc via the variable resistor VR1 or with the negative voltage source −Vcc via the variable resistor VR2. The control signal S therefore rises (or falls) at an inclination determined by the values of the variable resistor VR1 and capacitor C1 or of the variable resistor VR2 and capacitor C1. The inclination of the signal S is therefore constant, as shown in FIG. 6, irrespective of whether the signal is at a large signal level S3 or at a small signal level S4. And the time of response ($t_r$) of the propeller housing 21 to the steering arm 20 is constant irrespective of the signal level of the signal S. Furthermore, with this control system the response of the propeller housing 21 to the steering arm 20 is gentle as shown in FIG. 7-(*b*) even when the steering arm is abruptly operated in a reverse direction as shown in FIG. 7-(*a*), so that the mechanical components of this control system may not be subjected to undue force. In contrast, with the conventional control system, the direction of rotation of the propeller housing is more abruptly reversed (FIG. 7-(*c*)) when the steering arm is abruptly operated in the reverse direction (FIG. 7-(*a*)).

Figure 8:
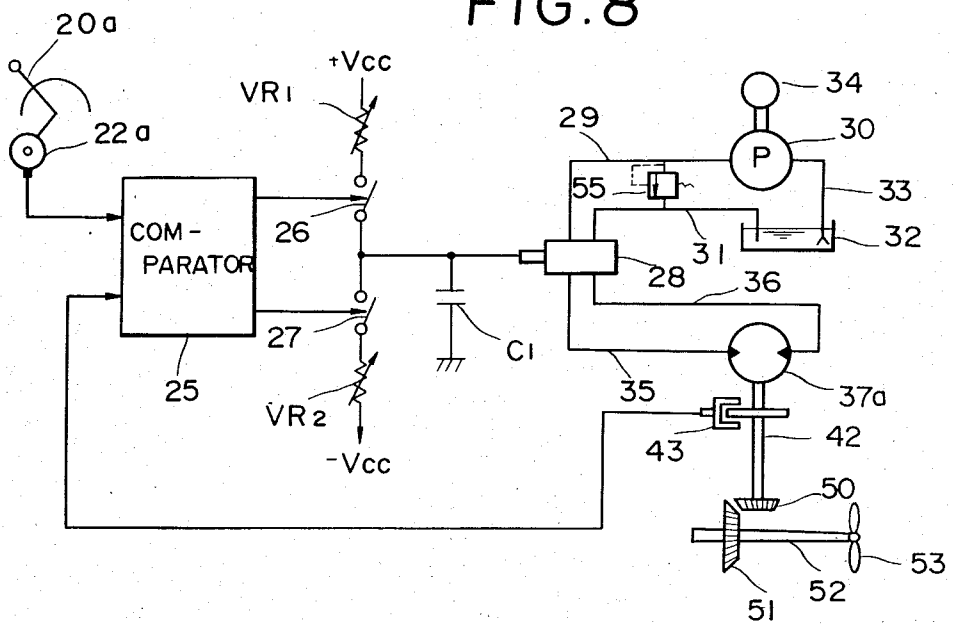
FIG. 8 is a block diagram of a system for controlling the rotational speed of a propeller, provided in accordance with the present invention.

FIG. 8 shows another control system according to the present invention in which the rotational speed of a propeller of a Z-type propulsion apparatus is controlled. The control system has a control arm 20*a* for controlling the rotational speed of the propeller 53 of the Z-type propulsion apparatus. The control arm 20*a* is provided with an angular position detector 22*a* such as a potentiometer and a synchro for generating a command signal representative of the rotational speed of the propeller 53 to be obtained. The command signal is supplied to one input terminal of the comparator 25. Mounted on the output shaft 42 of the hydraulic motor 37*a* is a rotational speed detector 43 such as a tachometer generator and a magnet disc. An output signal of the rotational speed detector 43 or a feedback signal is supplied to the other input terminal of the comparator 25. A bevel gear 50 is fixedly mounted on the shaft 42 and is engaged with another bevel gear 51 which is mounted on the shaft 52 of the propeller 53. There is provided between the connecting tubes 29 and 31 a relief valve 55.

Figure 9:
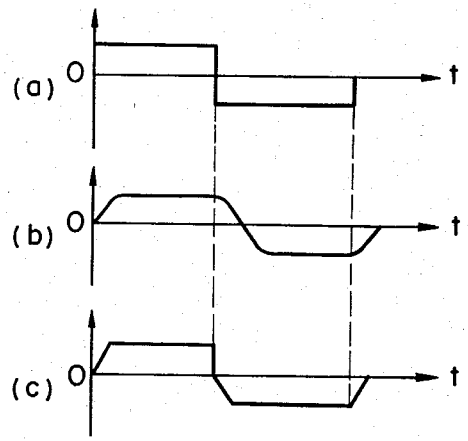
FIG. 9 is a diagrammatic illustration showing the response characteristic of the control system of FIG. 8 and of the conventional control system.

With this construction, the rotational speed of the propeller 53 varies in synchronism with the angular position of the control arm 20*a*. And errors in the rotational speed in the control system are remarkably reduced since the rotational speed of the shaft 42 is directly detected so that the control valve 28 is controlled in accordance with this detected speed. As a result, a fine adjustment of the rotational speed of the propeller 53 can be achieved, so that the steering performance can be much enhanced. In addition, this control system has less mechanical moving parts and therefore can be simple and compact in construction and also can be reduced in weight. Further, this control system may be subjected to less failures and therefore requires less maintenance. It is also to be noted that with this control system the propeller 53 is decelerated or accelerated gently to the speed selected by the arm 20*a*, as shown in FIG. 9-(*b*), even when the control arm 20*a* is operated abruptly in a reverse direction as shown in FIG. 9-(*a*). The mechanical parts are not therefore subjected to an excessive force. In contrast, with the construction of the conventional control systems the rotational speed of the propeller is abruptly varied, as shown in FIG. 9-(*c*), when the control arm 20*a* is operated in the same manner as described above (FIG. 9-(*a*)).

Figure 10:
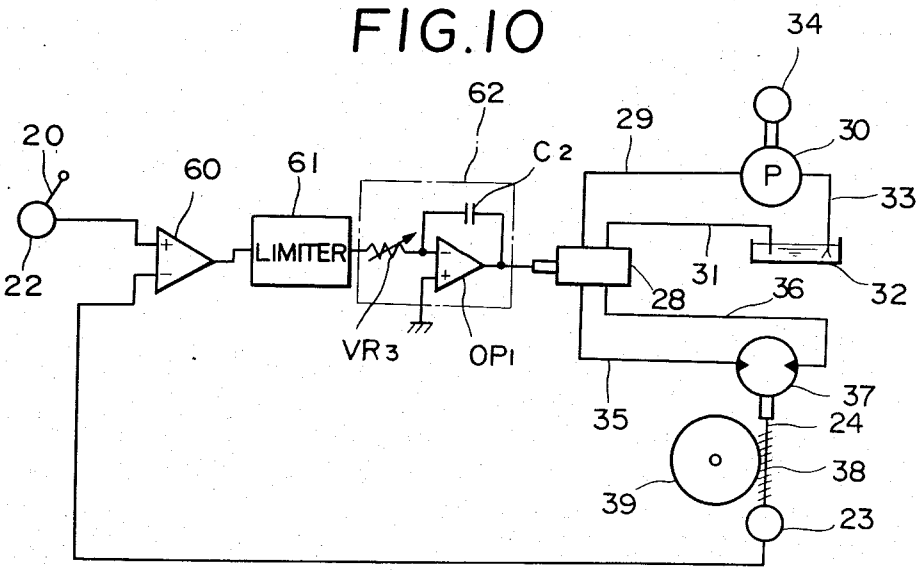
FIG. 10 is a block diagram similar to FIG. 4 but showing a modified control system.

FIG. 10 shows another modified control system according to the present invention in which the rotation of the propeller housing is controlled. In this control system the command signal outputted from the angular position detector 22 is supplied to one input terminal of an error detection circuit 60 such as an operational amplifier, and the feedback signal outputted from the angular position detector 23 is supplied to the other input terminal of the error detection circuit 60. An output terminal of the error detection circuit 60 is connected to an input terminal of a limiter 61. An output terminal of the limiter 61 is connected to an input terminal of an integrator circuit 62 which comprises a variable resistor VR3, a capacitor C2 and an operational amplifier OPl. The time constant of this integrator circuit 62 is preferably set to a smaller value in comparison with that of the servo-control circuit of the conventional control system. An output terminal of the integrator circuit 62 is connected to the input terminal of the control valve 28.

Figure 11:
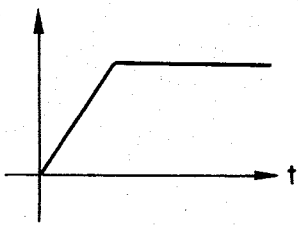
FIG. 11 is a diagrammatic illustration showing the wave form of the input signal of the control valve 28 of FIG. 10.

With this construction, when the steering arm 20 is pivoted by a desired amount of angle in a selected direction a voltage difference between the command and feedback signals appears at the input terminals of the error detection circuit 60. The error detection circuit 60 detects the voltage difference (error voltage) and outputs the amplified signal thereof. The limiter 61 limits the value of the amplified error voltage to a range within the predetermined positive and negative values. This limited error voltage is then supplied to the input terminal of the integrator circuit 62. The voltage applied from the integrator circuit 62 to the input terminal of the control valve 28 therefore rises (or falls) at a constant inclination as shown in FIG. 11. As a result, the hydraulic motor 37 is driven, so that the screw housing 21 begins to rotate in the selected direction. And when the angular position of the screw housing 21 coincides with that of the steering arm 20 the command signal and the feedback signal become equal in amplitude to each other, so that the output voltage of the integrator circuit 62 is rendered 0. As a result, the control valve 28 closes and therefore the hydraulic motor 37 is deactivated to stop the screw housing 21.

Figure 12:
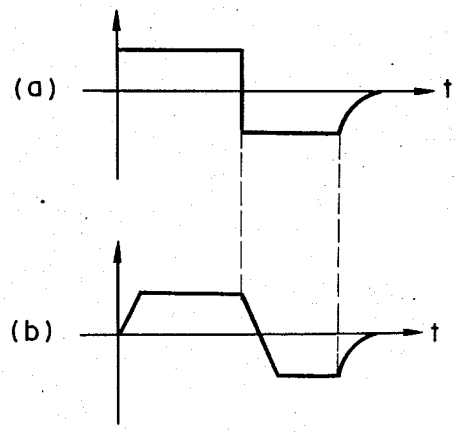
FIG. 12 is a diagrammatic illustration showing the response characteristic of the control system of FIG. 10 and of the control system.

This system has also less mechanical component parts in comparison with the conventional control systems, so that it can be simple and compact in construction and can be manufactured at lower costs. Further, the electronic circuit of this system functions not as an amplifier but as an integrator, and therefore this system is less sensitive to the variation of the ambient temperature and noises. Further, the positive and negative transition durations of rotational movement of the screw housing 21 can be easily adjusted by the range of the limiter circuit 61 or the variable resistor VR3. In addition, this control system can avoid vibration or hunting of the screw housing 21 by virtue of the provision of the limiter 61 and the integrator circuit 62 having the small time constant. The output signal of the integrator circuit 62 varies through the zero level at an appropriate inclination (see FIG. 12-(*b*)) even when the steering arm 20 is abruptly operated in a reverse direction (FIG. 12-(*a*)), so that the mechanical component parts of this control system may not be subjected to undue force. It should be also noted that the integrator circuit 62 having the small time constant functions as a memory for storing the controlled variable in this control system. The output signal of the integrator circuit 62 therefore varies within a very short period when the command signal is abruptly varied. In this case however, the error voltage does not exceed the predetermined levels, so that the time constant of the circuit 62 apparently appears to become greater. In addition, with this system hunting will not occur even when the error voltage is small since the time constant of the integrator circuit 62 is small.

Figure 13:
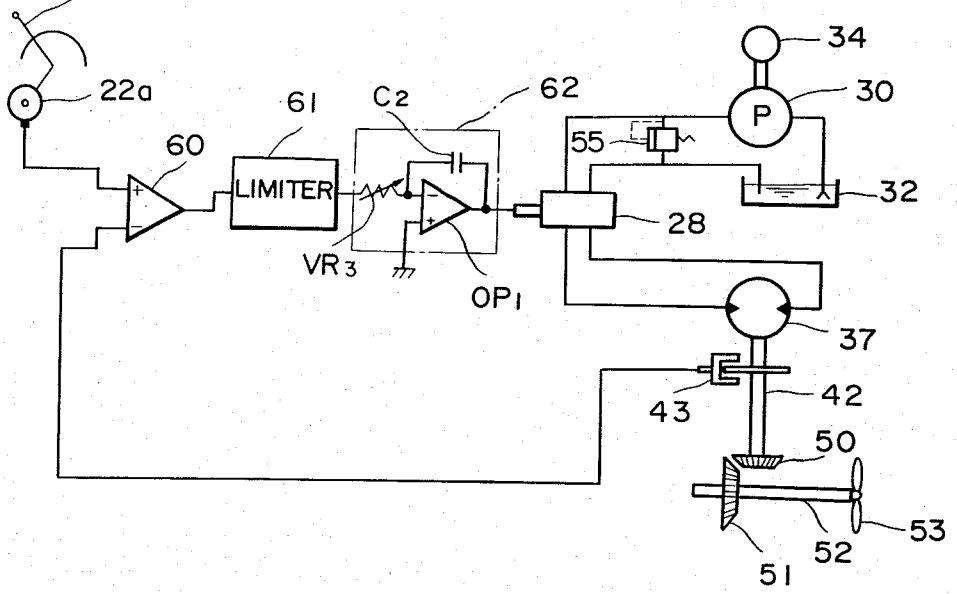
FIG. 13 is a block diagram similar to FIG. 8 but showing a modified control system.

FIG. 13 shows a further modified control system in which the rotational speed of the propeller 53 is controlled. This system differs from the system shown in FIG. 8 in the following respects. The command signal outputted from the angular position detector 22*a* is supplied to the one input terminal of the error detection circuit 60 while the feedback signal outputted from the rotational speed detector 43 is supplied to the other input terminal of the circuit 60. The output signal of the error detection circuit 60 or the error voltage is supplied through the limiter 61 and the integrator circuit 62 to the control valve 28 in a manner described for the control system shown in FIG. 10.

The operation of this system is almost equal to that of the system shown in FIG. 8.

What is claimed is:

1. A system for controlling the rotation of a rotary mechanism in a Z-type propulsion apparatus comprising:

(a) means for generating a command signal;

(b) means for detecting a feedback signal relating to the rotation of said rotary mechanism;

(c) means for generating a control signal whose signal level is varied at a predetermined inclination when signal levels of said command signal and feedback signal differ from each other, and said control signal generating means comprises (i) a comparator for comparing the signal level of said command and feedback signals with each other to generate one of the first and second energizing signals, said first energizing signal being generated when the signal level of said command signal is greater than that of said feedback signal, said second energizing signal being generated when the signal level of said command signal is less than that of said feedback signal, (ii) a first integrator circuit having a first resistor and a capacitor serially connected to each other, (iii) a second integrator circuit having a second resistor and said capacitor serially connected to each other, (iv) first switch means in response to said first energizing signal for applying a positive voltage to said first integrator circuit, and (v) second switch means in response to said second energizing signal for applying a negative voltage to said second integrator circuit, whereby said control signal appears across said capacitor; and (d) drive means for rotating said rotary mechanism in accordance with the signal level of said control signal.

2. A control system according to claim 1, wherein said control signal generating means comprises (a) an error detection circuit for detecting the voltage difference between said command and feedback signals; (b) a limiter for limiting the amplitude of said voltage difference; and (c) an integrator circuit for integrating said limited voltage difference to generate said control signal.

3. A control system according to claim 2, wherein said integrator circuit comprises an operational amplifier a resistor means connected between means connected between the inverting input terminal of said operational amplifier and the output terminal of said limiter and a capacitor connected between the inverting and output terminals of said operational amplifier, the non-inverting input terminal of said operation amplifier being grounded, and said control signal appearing at the output of terminal of said operational amplifier.

4. A control system according to claim 1, wherein said rotary mechanism is a propeller housing, said command signal generating means comprising a steering handle for commanding the rotation of said propeller housing, and first angular position detecting means for detecting the angular position of said steering handle as said command signal, said feedback signal detecting means comprising second angular position detecting means for detecting the angular position of said propeller housing.

5. A control system according to claim 1, wherein said rotary mechanism is a propeller, said command signal generating means comprising a control handle for commanding the rotational speed of said propeller, and angular position detecting means for detecting the angular position of said control handle as said command signal, said feedback signal detecting means comprising rotational speed detecting means for detecting the rotational speed of said propeller.

6. A control system according to claim 4, wherein said drive means comprises a motor, a hydraulic pump activated by said motor, a hydraulic motor operatively connected to said propeller housing for rotation, and a control valve connected between said hydraulic pump and hydraulic motor for controlling the amount and direction of flow of oil supplied from said hydraulic pump to said hydraulic motor.

7. A control system according to claim 5, wherein said drive means comprises a motor, a hydraulic pump activated by said motor, a hydraulic motor operatively connected to said propeller for rotation, and a control valve connected between said hydraulic pump and hydraulic motor for controlling the amount and direction of flow of oil supplied from said hydraulic pump to said hydraulic motor.

* * * * *